US010354779B2

(12) United States Patent
Hazenfield et al.

(10) Patent No.: US 10,354,779 B2
(45) Date of Patent: Jul. 16, 2019

(54) FREE AIR FIRE ALARM CABLE

(71) Applicant: Wire Holdings, LLC, Cleveland, OH (US)

(72) Inventors: Robert C. Hazenfield, Aurora, OH (US); Jay H. Osborne, Jr., Chardon, OH (US)

(73) Assignee: Radix Wire & Cable, LLC, Euclid, OH (US)

( * ) Notice: Subject to any disclaimer, the term of this patent is extended or adjusted under 35 U.S.C. 154(b) by 0 days.

(21) Appl. No.: 15/727,679

(22) Filed: Oct. 9, 2017

(65) Prior Publication Data

US 2018/0286536 A1 Oct. 4, 2018

Related U.S. Application Data

(60) Provisional application No. 62/479,666, filed on Mar. 31, 2017.

(51) Int. Cl.

| | |
|---|---|
| ***H01B 7/00*** | (2006.01) |
| ***H01B 7/295*** | (2006.01) |
| *H01B 3/04* | (2006.01) |
| *H01B 13/016* | (2006.01) |
| *H01B 11/18* | (2006.01) |
| *H01B 3/44* | (2006.01) |

(52) U.S. Cl.

CPC ..... *H01B 7/295* (2013.01); *H01B 3/04* (2013.01); *H01B 3/445* (2013.01); *H01B 11/1847* (2013.01); *H01B 13/016* (2013.01)

(58) Field of Classification Search

CPC ..... H01B 3/04; H01B 3/445; H01B 7/295; H01B 11/1847; H01B 13/016

USPC ..... 174/110 R, 110 AR–110 E, 120 R, 174/120 C–120 SR, 121 R, 121 A, 174/121 AR–121 SR, 122 R–124 GC

See application file for complete search history.

(56) References Cited

U.S. PATENT DOCUMENTS

| | | | | | |
|---|---|---|---|---|---|
| 1,993,424 | A * | 3/1935 | Weber | H01B 7/28 | 174/107 |
| 2,124,993 | A * | 7/1938 | Youmans | H01B 7/025 | 174/121 R |
| 3,588,318 | A * | 6/1971 | Ollis | H01B 3/30 | 174/121 AR |

(Continued)

FOREIGN PATENT DOCUMENTS

| | | | | |
|---|---|---|---|---|
| CA | 1 319 401 | | 6/1993 | |
| CN | 204390783 U | * | 6/2015 | H01B 7/295 |

(Continued)

OTHER PUBLICATIONS

PENTAIR, "Pyrotenax System 1850 Fire-Rated Cable System," Thermal Building Solutions, Jan. 2016 www.pentairthermal.com.

(Continued)

*Primary Examiner* — William H. Mayo, III

(74) *Attorney, Agent, or Firm* — Emerson Thomson Bennett, LLC; Daniel A. Thomson

(57) ABSTRACT

An electric wire includes a metal conductor, a heat stable tape, wherein the tape is in direct contact with the conductor, wherein the tape can withstand temperatures of at least about 1850° F., a high temperature fiberglass layer, wherein the fiberglass layer is in direct contact with the tape, and an insulating sheath around the fiberglass layer, wherein the wire has no conduit protection.

16 Claims, 6 Drawing Sheets

(56) References Cited

U.S. PATENT DOCUMENTS

| | | | | | |
|---|---|---|---|---|---|
| 4,051,324 | A * | 9/1977 | Anderson | H01B 3/065 | 174/121 R |
| 4,547,626 | A * | 10/1985 | Pedersen | G02B 6/4416 | 174/107 |
| 4,818,060 | A | 4/1989 | Arroyo | | |
| 4,874,219 | A | 10/1989 | Arroyo et al. | | |
| 5,336,851 | A | 8/1994 | Sawada et al. | | |
| 5,422,614 | A * | 6/1995 | Rampalli | H01B 7/295 | 174/121 A |
| 2002/0046871 | A1 * | 4/2002 | Goeblmaier | H01B 7/0258 | 174/121 A |
| 2002/0117325 | A1 * | 8/2002 | Mennone | H01B 7/295 | 174/121 A |
| 2006/0054334 | A1 * | 3/2006 | Vaupotic | H01B 11/1008 | 174/36 |
| 2014/0008098 | A1 * | 1/2014 | Scaglione | H01B 7/18 | 174/107 |
| 2016/0329129 | A1 | 11/2016 | Osborne, Jr. et al. | | |

FOREIGN PATENT DOCUMENTS

| | | | | |
|---|---|---|---|---|
| DE | 41 32 390 | | 4/1993 | |
| GB | 1169693 | * | 8/1965 | B32B 19/06 |
| GB | 2 448 778 | | 4/2010 | |
| GB | 2448778 A | * | 4/2010 | H01B 7/295 |
| WO | 00 453 95 | | 3/2000 | |
| WO | 2007 057 251 | | 5/2007 | |
| WO | 2016 128 785 | | 8/2016 | |

OTHER PUBLICATIONS

Israel Patent Office, International Search Report/Written Opinion, Feb. 26, 2018.

* cited by examiner

FREE AIR FIRE ALARM CABLE

This application claims priority to U.S. Ser. No. 62/479,666, filed Mar. 31, 2017, which is incorporated herein by reference.

I. BACKGROUND

A. Field

The present teachings generally relate to methods and apparatuses for electrical wire, and more particularly to free air fire alarm cable.

B. Background

Fire safety cable (critical circuit cable) finds application in providing electrical power to equipment and systems that are required to function during a fire. These systems may include fire alarm controllers, fire suppression equipment, sprinkler pumps in high rise buildings or other environments. This equipment needs to operate for a sufficient period of time to allow the safe evacuation of people the location of the fire.

Fire performance cables are required to continue to operate and provide circuit integrity when they are subjected to fire. To meet some of the standards, cables must typically maintain electrical circuit integrity when heated to a specified temperature (e.g. 650, 750, 950, 1050° C.) in a prescribed way for a specified time (e.g. 15 minutes, 30 minutes, 60 minutes, 2 hours). In some cases the cables are subjected to regular mechanical shocks, before, during and after the heating stage. Often they are also subjected to water jet or spray, either in the latter stages of the heating cycle or after the heating stage in order to gauge their performance against other factors likely to be experienced during a fire.

These requirements for fire performance cables have been met previously by wrapping the conductor of the cable with tape made with glass fibers and treated with mica. Such tapes are wrapped around the conductor during production and then at least one insulative layer is subsequently applied. Upon being exposed to increasing temperatures, the outer insulative layers are degraded and fall away, but the glass fibers hold the mica in place.

In the past the electrical power was provided through the use of mineral insulated cable. More recently, new and improved wire insulation material has been introduced for the safety cable (critical circuit) application. Today, a material of choice for wire insulation is a silicone rubber that has been specially formulated to form a ceramic-like layer when heated to the temperatures that are present in a fire.

The wire construction for safety cable (CI—"circuit integrity") is typically a copper conductor. Over the copper conductor is applied the ceramifiable silicon rubber insulation. A jacket material is applied over the silicone insulation to provide mechanical protection during installation. One safety cable (CI) requirement for this family of cables is a fire test where the cables are installed in a manufacturer's specified system, and then tested for functionality in a furnace that models petroleum-fueled fire. In one test protocol the furnace is programmed to subject the test samples to a temperature rise on ambient to 1010° C. over a period of 2 hours. During this test the cables are energized to the voltage appropriate to the cables specified application. One test used is UL 2196 for 2 hours. To meet the requirements of the UL2196 test, electrical functionality must be maintained throughout the 2 hours and the following simulated fire hose water spray test.

The UL2196 test method described in these requirements is intended to evaluate the fire resistive performance of electrical cables as measured by functionality during a period of fire exposure, and following exposure to a hose stream. To maintain the functionality of electrical cables during a fire exposure the cables are tested using a fire resistive barrier. The fire resistive barrier is the cable jacketing if the jacketing is designed to provide fire resistance. If the cable jacketing is not designed to provide fire resistance, the electrical cables are either placed within a fire resistive barrier or installed within an hourly rated fire resistive assembly. Fire resistive cables intended to be installed with a non-fire resistive barrier (such as conduit) are tested with the non-fire resistive barrier included as part of the test specimen. Otherwise fire resistive cables incorporating a fire resistive jacket are tested without any barrier. To demonstrate each cable's ability to function during the test, voltage and current are applied to the cable during the fire exposure portion of the test, and the electrical and visual performance of the cable is monitored. The cable is not energized during the hose spray, but it is visually inspected and electrically tested after the hose spray. The functionality during a fire exposure of non-fire resistive electrical cables which are intended for installation within fire harriers or for installation within hourly rated fire resistive assemblies is determined by tests conducted in accordance with the UL Outline of Investigation for Fire Tests for Electrical Circuit Protective Systems, Subject 1724. Two fire exposures are defined: a normal temperature rise fire and a rapid temperature rise fire. The normal temperature rise fire is intended to represent a fully developed interior building fire. The rapid temperature rise fire is intended to represent a hydrocarbon pool fire. Two hose stream exposures are defined: a normal impact hose stream and a low impact hose stream. The low impact hose stream is applied only to cable intended to contain the identifying suffix "CI" to identify it as CI cable in accordance with the Standard for Cables for Power-Limited Fire-Alan Circuits, UL 1424, and in accordance with the Standard for Cables for Non-Power-Limited Fire-Alarm Circuits, UL 1425. In addition to fire alarm cables referenced in UL 1424 and UL1425, power cables can also be approved fir critical circuit applications. These power cables must meet the performance requirements listed in UL 444. Type RHH, RHW2, RHW and others of this standard if able to pass UL2196 can be qualified for CI applications, In addition to the UL 2196 test, the circuit integrity (CI) must also meet the electrical requirements for non-CI rated cable. One of the requirements for this family of cables is long term insulation resistance. For this test, a copper conductor, with only the silicone rubber used as insulation, is tested at the specified voltage while the cable is immersed in 90° C. water. The insulation resistance is monitored periodically. The decrease in resistance must level out at a value above the minimum required. One of the requirements is specified in UL 444. This compound can pass the requirements of UL 2196, but is marginal to unable to meet the requirements of UL 444 for insulation resistance long term in 90° C. water at rated voltage.

This UL44 test specifies the requirements for single-conductor and multiple-conductor thermoset-insulated wires and cables rated 600 V, 1000 V, 2000 V, and 5000 V, for use in accordance with the rules of the *Canadian Electrical Code* (*CEC*), *Part* 1, CSA C22.1, in Canada, *Standard for Electrical Installations*, NOM-001-SEDE, in Mexico, and the *National Electrical Code* (*NEC*), NFPA-70, in the United States of America.

Plenum cable is cable that is laid in the plenum spaces of buildings. Plenum spaces are the part of a building that can facilitate air circulation for heating and air conditioning systems, by providing pathways for either heated/conditioned or return airflows, usually at greater than atmospheric pressure. Space between the structural ceiling and the dropped ceiling or under a raised floor is typically considered plenum. In the United States, plastics used in the construction of plenum cable are regulated under the National Fire Protection Association standard NFPA 90A: Standard for the Installation of Air Conditioning and Ventilating Systems. All materials intended for use on wire and cables to be placed in plenum spaces are designed to meet rigorous fire safety test standards in accordance with NFPA 262 and outlined in NFPA 90A.

Plenum cable is jacketed with a fire-retardant plastic jacket of either a low-smoke polyvinyl chloride (PVC) or a fluorinated ethylene polymer (FEP). Polyolefin formulations, specifically based on polyethylene compounding had been developed by at least two companies in the early to mid-1990s; however, these were never commercialized, and development efforts continue in these yet-untapped product potentials. Development efforts on a non-halogen plenum compound were announced in 2007 citing new flame-retardant synergist packages that may provide an answer for an yet-underdeveloped plenum cable market outside the United States.

Plenum spaces allow fire and smoke to travel quickly. By using plenum-rated cable, the levels of toxicity in the smoke would be lower since plenum cable is coated with a jacket that is typically made of flame-resistant material such as Teflon®. This special jacketing, makes the cable smoke less than regular PVC cable and the smoke that is emitted is less toxic.

The NFPA (National Fire Protection Agency) is the body in charge of setting the code requirements for protecting plenum air spaces (as well as other fire concerns) and the National Electric Code or NEC is the standard they provide for handling all cables including power, network and video cabling. In NEC Section 800 it describes the properties of cables used for network and AV cabling. Any Nationally Recognized Testing Laboratory (NRTL) can certify NEC compatibility. Underwriter Laboratories (UL) is the de facto standard for making sure that cables meet or exceed all of the required specifications.

When exposed to fire, copper conductors may melt. At first, there is blistering and distortion of the surface. The striations created on the surface of the conductor during manufacture become obliterated. The next stage is some flow of copper on the surface with some hanging drops forming. Further melting may allow flow with thin areas (i.e., necking and drops). In that circumstance, the surface of the conductor tends to become smooth. The resolidified copper forms globules. Globules caused by exposure to fire are irregular in shape and size. They are often tapered and may be pointed. There is no distinct line of demarcation between melted and unmelted surfaces. As the copper conductor nears its melting point, the conductor softens and expands. The rate of expansion can be greater than the conductors ability to yield and the conductor buckles. At this point, the conductor can burst out of the insulation, which can lead to failure.

II. SUMMARY

In accordance with one aspect of the present teachings, a free air fire alarm cable includes a metal conductor, wherein the conductor has an AWG of 12 or smaller, wherein the metal conductor has a top and a bottom, a first mica layer in direct contact with the metal conductor, wherein the first mica layer has a first edge and a second edge, wherein the first mica layer is folded around the metal conductor such that the first edge and second edge are substantially parallel to one another and the first edge overlaps the second edge on the bottom of the metal conductor, a first high tensile, high temperature fiberglass layer clockwise spiral-wrapped directly onto the first mica layer, the first fiberglass layer having a top and a bottom, a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer, a second high tensile, high temperature fiberglass layer counterclockwise spiral-wrapped directly onto the second mica layer, and a insulating sheath around the second fiberglass layer, wherein the cable has no conduit.

In accordance with one aspect of the present teachings, an electric wire includes a metal conductor, a heat stable tape, wherein the tape is in direct contact with the conductor, wherein the tape can withstand temperatures of at least about 1850° F. (1010° C.), a high temperature fiberglass layer, wherein the fiberglass layer is in direct contact with the tape, and an insulating sheath around the fiberglass layer, wherein the wire has no conduit protection.

In accordance with one aspect of the present teachings, the tape has a first edge and a second edge, wherein the tape is folded around the metal conductor such that the first edge and second edge are substantially parallel to one another and the first edge overlaps the second edge.

In accordance with one aspect of the present teachings, the fiberglass layer is braided over the tape.

In accordance with one aspect of the present teachings, the tape is mica tape.

In accordance with one aspect of the present teachings, the fiberglass layer is a two directional serve layer.

In accordance with one aspect of the present teachings, the tape is folded around the conductor.

In accordance with one aspect of the present teachings, the tape is mica and is a first mica layer, the high temperature fiberglass layer is a first fiberglass layer, the metal conductor has a top and a bottom, the wire further includes the first mica layer having a first edge and a second edge, wherein the first mica layer is folded around the metal conductor such that the first edge and second edge are substantially parallel to one another and the first edge overlaps the second edge on the bottom of the metal conductor, the first high temperature fiberglass layer clockwise spiral-wrapped directly onto the first mica layer, the first fiberglass layer having a top and a bottom, a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer, and a second high temperature fiberglass layer counterclockwise spiral-wrapped directly onto the second mica layer, wherein the insulating sheath is around the second fiberglass layer.

In accordance with one aspect of the present teachings, the conductor has an AWG of 12 or smaller.

In accordance with one aspect of the present teachings, a plenum-rated electric wire includes a metal conductor, a heat stable tape, wherein the tape is in direct contact with the conductor, wherein the tape can withstand temperatures of at least about 1850° F. (1010° C.), a high temperature fiberglass layer, wherein the fiberglass layer is in direct contact with the tape, wherein there is no silicone between the tape and the fiberglass layer, and a plenum-rated insulating sheath around the fiberglass layer.

In accordance with one aspect of the present teachings, the wire further includes a plenum-rated jacket around the insulating sheath, wherein the wire has no conduit protection.

In accordance with one aspect of the present teachings, the wires meet the same mandatory pathway survivability requirements of CIC cables without the cost and labor installation.

In accordance with one aspect of the present teachings, the wire meet National Fire Protection Code (NFPA 72), are UL 2196 Certified, UL 1424 Listed, 300V, 75° C. Classified In accordance with one aspect of the present teachings, the wire has a Low Smoke PVC with fire installation system, and has oxygen-free bare copper (OFHC) conductors, solid and stranded, and has three twists per foot.

Other benefits and advantages will become apparent to those skilled in the art to which it pertains upon reading and understanding of the following detailed specification.

III. BRIEF DESCRIPTION OF THE DRAWINGS

The present teachings are described hereinafter with reference to the accompanying drawings.

IV. DETAILED DESCRIPTION

Figure 5A:
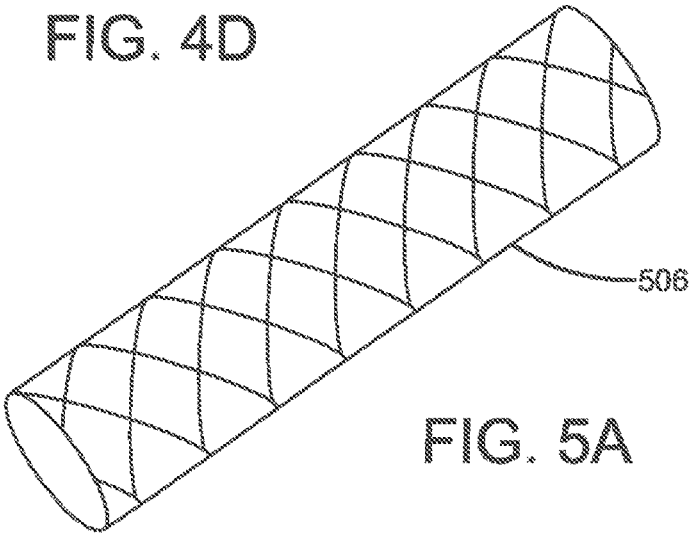
FIG. 5A shows a perspective view of another embodiment of the wire with a fiberglass layer braided around the mica layer.
Figure 5B:
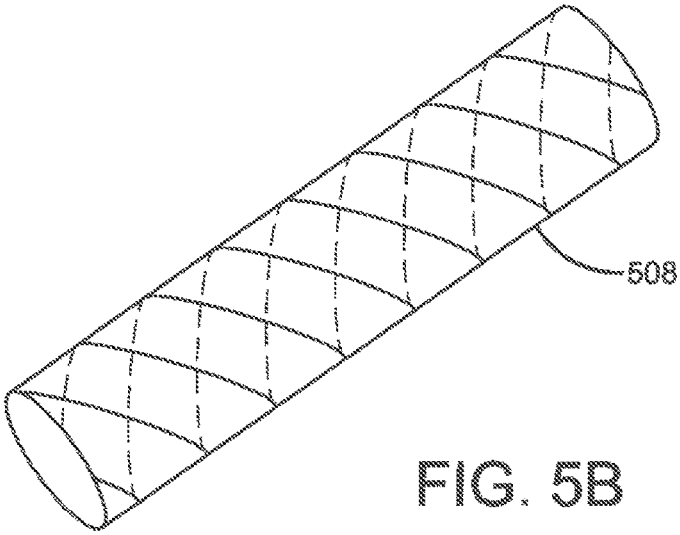
FIG. 5B shows a perspective view of another embodiment of the wire with a two directional serve fiberglass layer around the mica layer.
Figure 7:
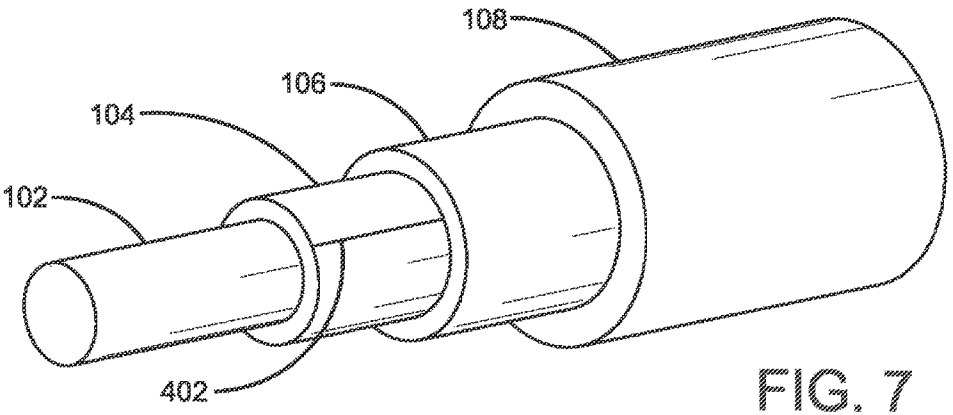
FIG. 7 shows a cutaway perspective view of the wire of FIG. 1.
Figure 9:
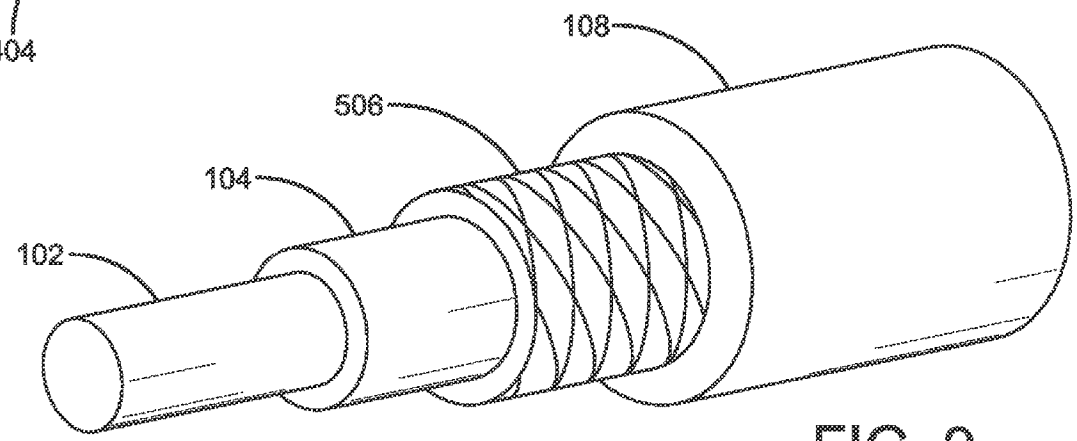
FIG. 9 shows a cutaway perspective view of the wire of FIG. 5A.
Figure 10:
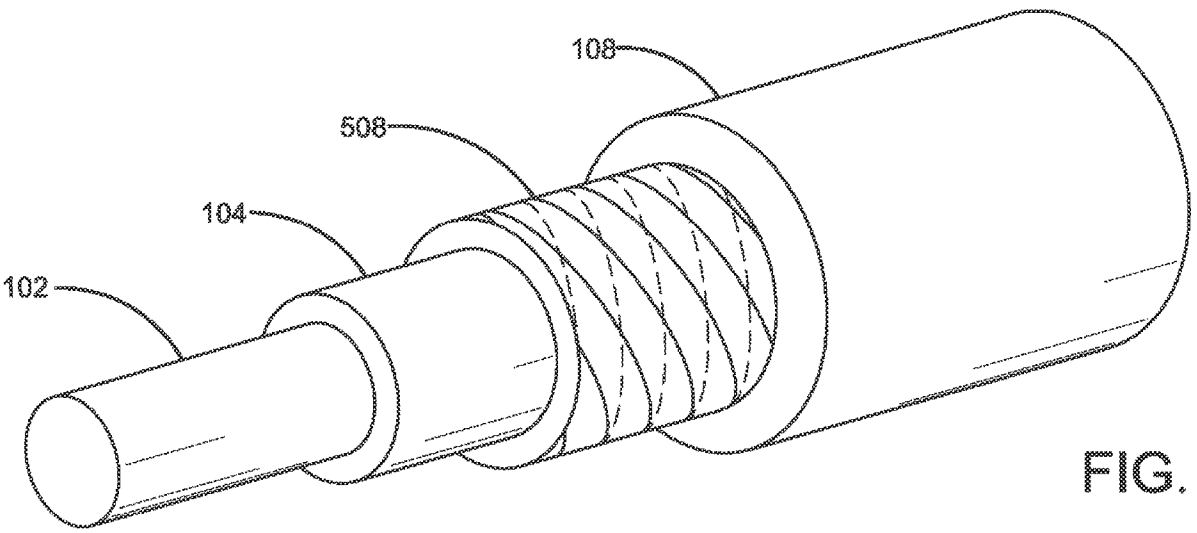
FIG. 10 shows a cutaway perspective view of the wire of FIG. 5B.
Figure 11:
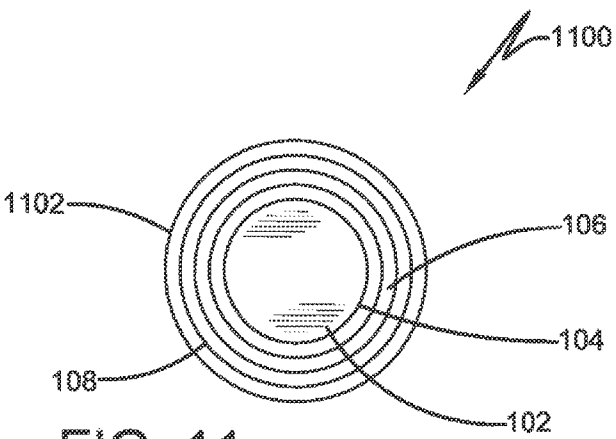
FIG. 11 shows a cross-sectional view of the wire of FIG. 1 with a jacket.

In reference to the FIGS. 1, 5A, 5B, 7, 9, 10, and 11, a wire 100, designed for a free air fire alarm cable, is shown. The wire 100 has a metal conductor 102, with a heat stable tape layer 104 folded around the conductor 102. A high tensile, high temperature fiberglass layer 106 is wrapped around the heat tape layer 104. Around the fiberglass layer 106 is an insulating sheath 108. The heat stable tape layer 104, which is a high temperature adhesive that can withstand temperatures of at least 1850° F. (1010° C.), is in direct contact with the conductor 102. The heat stable tape layer 104 can be mica, and the folded nature of the heat stable tape layer 104 creates a sleeve for the conductor 102, which allows some movement of the conductor 102. The fiberglass layer 106 is in direct contact with the heat stable tape layer 104, and operates as a strength member to prevent buckling of the conductor 102. The wire 100 does not have a conduit, and will be held with rings or straps from the rafters in the ceiling of the building after installation. In one aspect, the conductor 102 is copper and has an AWG of 12 or smaller. With particular reference to FIGS. 5A and 9, the fiberglass layer 506 can be a braided layer. With particular reference to FIGS. 5B and 10, the fiberglass layer 508 can be a two directional serve layer. With reference to FIG. 7, the heat stable tape layer 104 has a first edge 402 and a second edge 404, wherein when the heat stable tape layer 104 is folded around the conductor 102, the first edge 402 slightly overlaps the second 404. With reference to FIG. 11, wire 100 can have a jacket 1100 around the insulating sheath 108.

Figure 6:
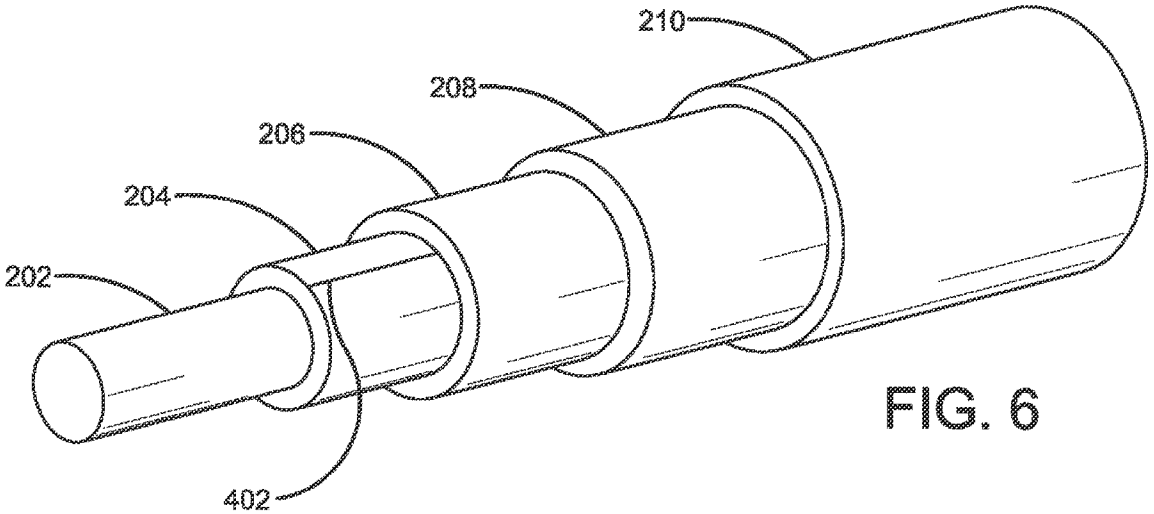
FIG. 6 shows a cutaway perspective view of the wire of FIG. 2.

With reference to FIGS. 2, 5A, 5B, 6, 9, and 10, another aspect of the present teachings shows a plenum-rated wire 200 is shown, having a metal conductor 202, with a heat stable tape layer 204 folded around the conductor 202. A high tensile, high temperature fiberglass layer 206 is wrapped around the heat tape layer 204. Around the fiberglass layer 206 is a plenum-rated insulating sheath 208, and around the sheath 208 is a plenum-rated jacket 210. The heat stable tape layer 204, which is a high temperature adhesive that can withstand temperatures of at least 1850° F. (1010° C.), is in direct contact with the conductor 202. The heat stable tape layer 204 can be mica, and the folded nature of the heat stable tape layer 204 creates a sleeve for the conductor 202, which allows some movement of the conductor 202. The fiberglass layer 206 is in direct contact with the heat stable tape layer 204, and operates as a strength member to prevent buckling of the conductor 202. The wire 200 has no silicone between the heat stable tape layer 204 and the fiberglass layer 206. The wire 200 does not have a conduit, and will be held with rings or straps from the rafters in the ceiling of the building after installation. In one aspect, the conductor 202 is copper and has an AWG of 12 or smaller. With particular reference to FIGS. 5A and 9, the fiberglass layer 506 can be a braided layer. With particular reference to FIGS. 5B and 10, the fiberglass layer 508 can be a two directional serve layer. With reference to FIG. 6, the heat stable tape layer 204 has a first edge 402 and a second edge 404, wherein when the heat stable tape layer 204 is folded around the conductor 202, the first edge 402 slightly overlaps the second 404.

With reference to FIGS. 3, 4A, 4B, 4C, 4D, 8, and 12, a wire 300, designed for a free air fire alarm cable, is shown.

Figure 3:
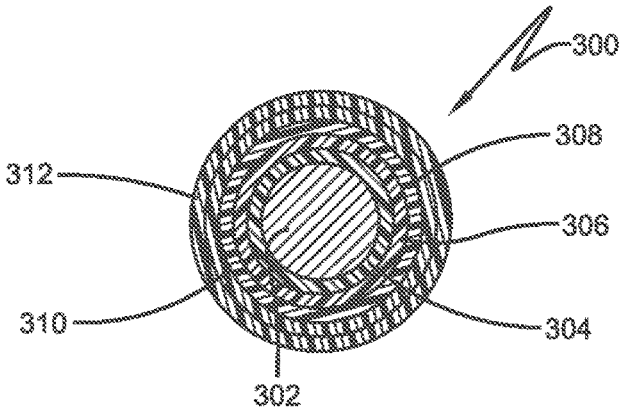
FIG. 3 shows a cross-sectional view of another embodiment of the wire.
Figure 4A:
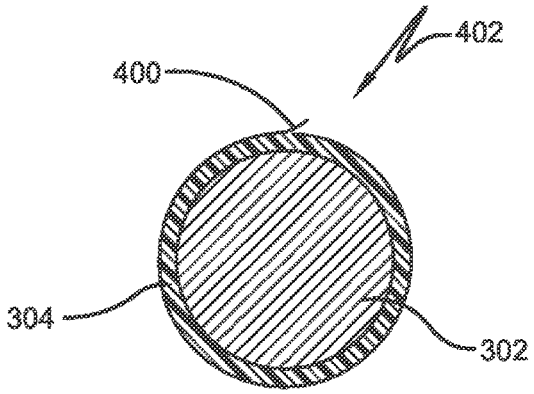
FIG. 4A shows a cross-sectional view of the metal conductor of FIG. 3 and the first mica layer folded around the conductor.
Figure 4B:
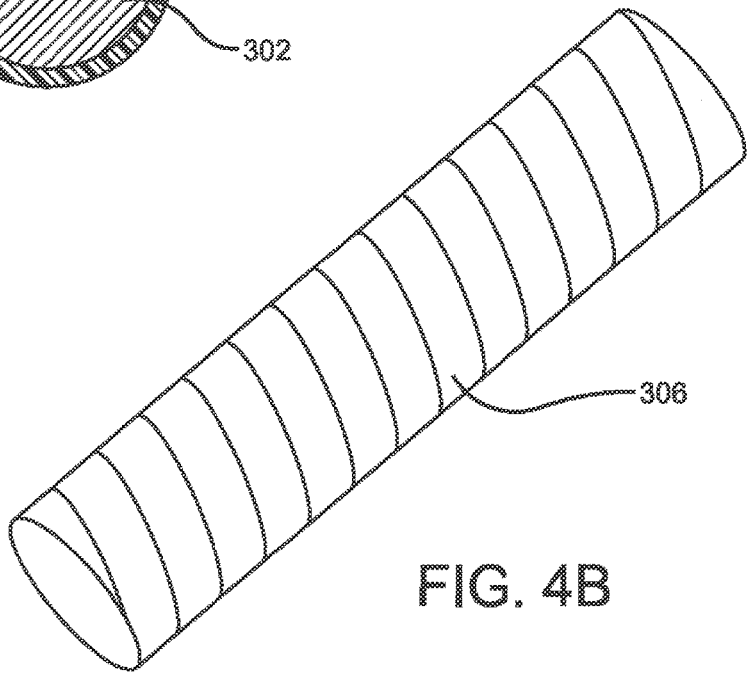
FIG. 4B shows a perspective view of the first fiberglass layer wrapped clockwise around the first mica layer of FIG. 3.
Figure 4C:
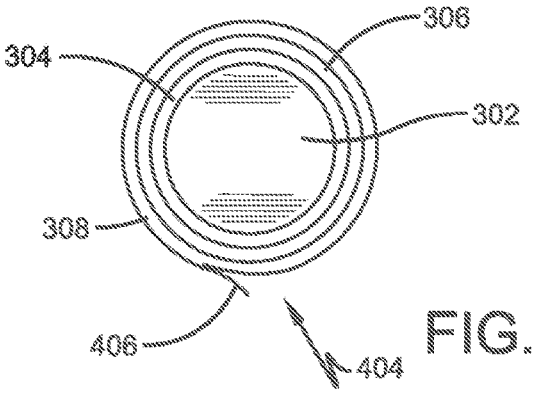
FIG. 4C shows a cross-sectional view of the first mica layer, the first fiberglass layer, and the second mica layer folded around the first fiberglass layer of FIG. 3.
Figure 4D:
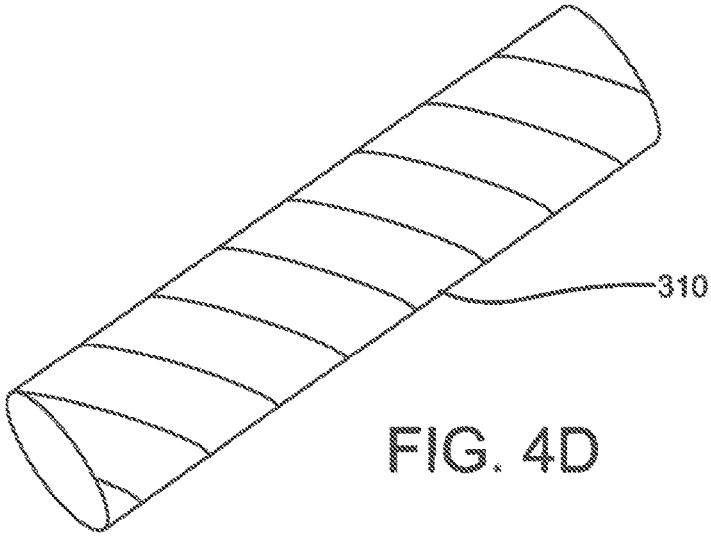
FIG. 4D shows a perspective view of the second fiberglass layer wrapped counterclockwise around the second mica layer of FIG. 3.
Figure 8:
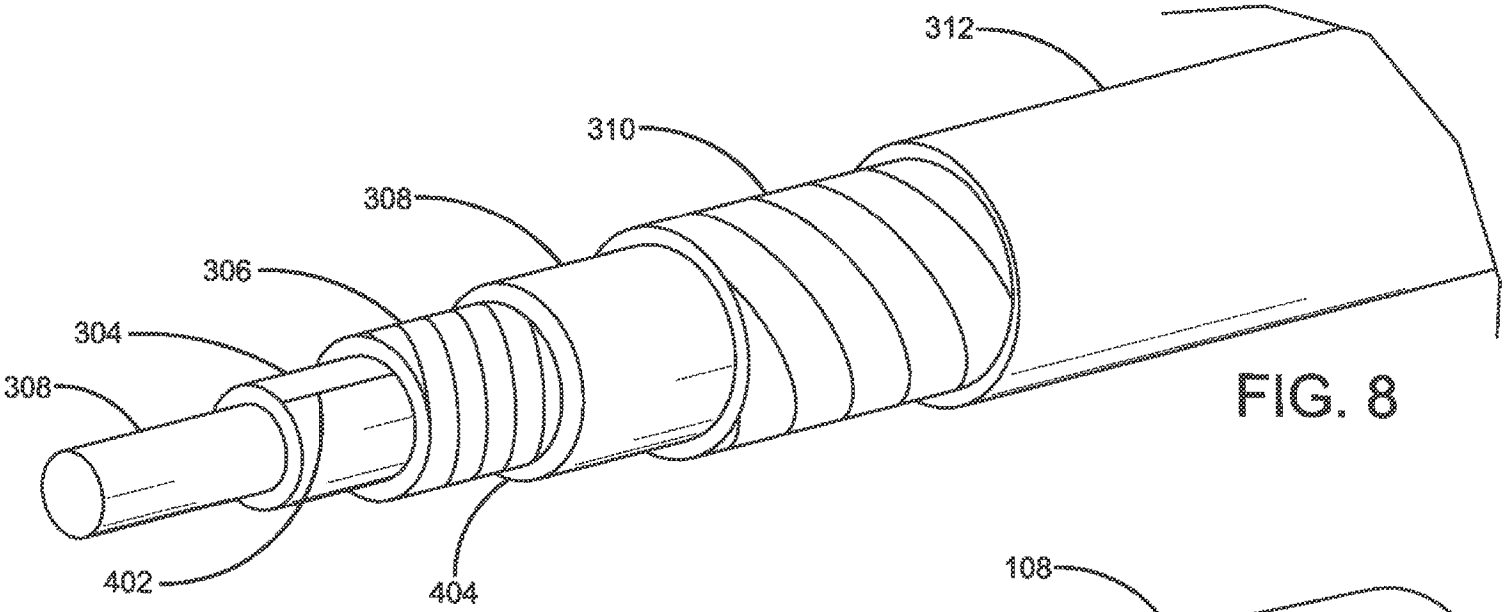
FIG. 8 shows a cutaway perspective view of the wire of FIG. 3.
Figure 12:
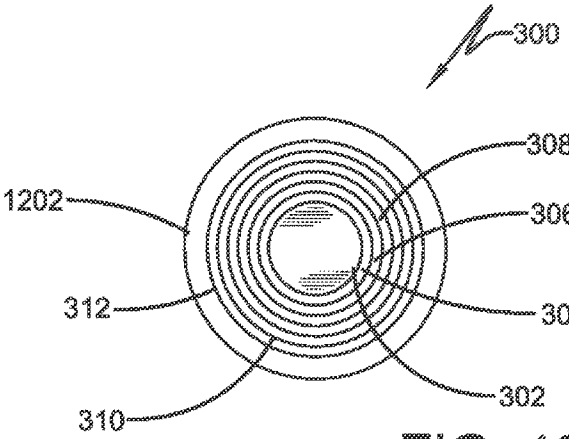
FIG. 12 shows a cross sectional view of the FIG. 3 with a jacket.

The wire 300 has a metal conductor 302 having a top and a bottom (shown but not referenced). A first mica layer 304 is in direct contact with the metal conductor 302, and is folded around the metal conductor 302. The first mica layer 304 has a first edge 402 and a second edge 400 (shown in FIG. 4A), wherein the first mica layer 304 is folded around the metal conductor 302 in such a way that the edges 400, 402 are substantially parallel with one another, and the first edge 402 slightly overlaps the second edge 400 at the top of the metal conductor 302. A first high tensile, high temperature fiberglass layer 306 is in direct contact with the first mica layer 304, wherein the first fiberglass layer has a top and a bottom (shown but not referenced). The first fiberglass layer 306 is clockwise spiral-wrapped around the first mica layer 304 (as shown in FIG. 4B). A second mica layer 308 is in direct contact with the first fiberglass layer 304, wherein the second mica layer 308 has a first edge 404 and a second edge 406. The second mica layer 308 is folded around the first fiberglass layer 306 in such a way that the edges 404, 406 are substantially parallel with one another, and the first edge 404 slightly overlaps the second edge 406 at the bottom of the first fiberglass layer 306 (shown in FIG. 4C). A second high tensile, high temperature fiberglass layer 310 is in direct contact with the second mica layer 308. The second fiberglass layer 310 is counterclockwise spiral-wrapped around the second mica layer 308 (as shown in FIG. 4D). An insulating sheath 312 is on the outside of the second fiberglass layer 310 as shown in FIGS. 3 and 8. With reference to FIG. 12, wire 300 can have a jacket 1200 around the insulating sheath 312.

Figure 1:
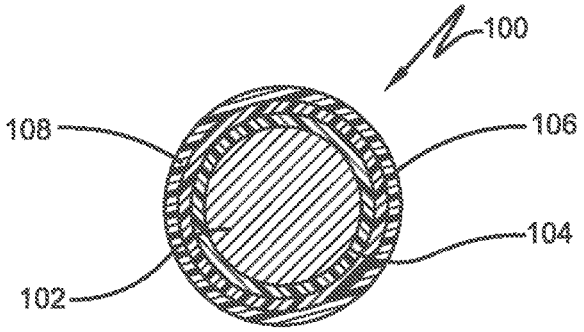
FIG. 1 shows a cross-sectional view of the wire with an insulating sheath.
Figure 2:
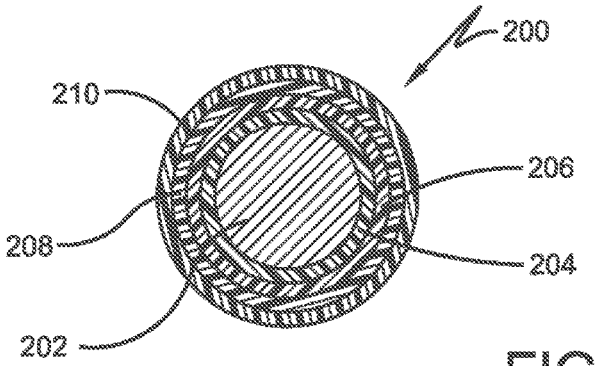
FIG. 2 shows a cross-sectional view of the plenum rated wire with an insulating sheath and jacket.

With reference now to FIG. 2, it is to be understood that the multiple mica layers as described in FIGS. 3, 4A-4D, and 8, can be used in the plenum rated wire 200 of FIG. 2. With reference now to FIG. 1, it is to be understood that the multiple mica layers as described in FIGS. 3, 4A-4D, and 8, can be used in the wire 100 of FIG. 1.

EXAMPLE

In a UL® 2196 test, the wire 200 was tested, and the leakage rates were between 0.44 mA and 9.34 mA and the circuit continuities were all still intact.

In one example a wire has an 18 AWG solid conductor with a 0.022 inch (0.556 mm) insulation thickness, a nominal jacket thickness of 0.022 inch (0.556 mm), a nominal outer diameter of 0.240 inch (6.10 mm), a nominal capacitance of 11.17 pF/FT (36.65 pF/m), and a characteristic impedance at 1 MHz of 140.7 ohms.

In one example a wire has an 16 AWG solid conductor with a 0.022 inch (0.556 mm) insulation thickness, a nominal jacket thickness of 0.022 inch (0.556 mm), a nominal outer diameter of 0.248 inch (6.30 mm), a nominal capacitance of 12.39 pF/FT (40.65 pF/m), and a characteristic impedance at 1 MHz of 114.6 ohms.

In one example a wire has an 14 AWG solid conductor with a 0.022 inch (0.556 mm) insulation thickness, a nominal jacket thickness of 0.022 inch (0.556 mm), and a nominal outer diameter of 0.252 inch (6.40 mm).

In one example a wire has an 14 AWG 7-strand conductor with a 0.022 inch (0.556 mm) insulation thickness, a nominal jacket thickness of 0.022 inch (0.556 mm), a nominal outer diameter of 0.263 inch (6.68 mm), a nominal capacitance of 14.76 pF/FT (48.43 pF/m), and a characteristic impedance at 1 MHz of 106.7 ohms.

In one example a wire has an 12 AWG solid conductor with a 0.022 inch (0.556 mm) insulation thickness, a nominal jacket thickness of 0.022 inch (0.556 mm), and a nominal outer diameter of 0.272 inch (6.91 mm).

In one example a wire has an 12 AWG 7-strand conductor with a 0.022 inch (0.556 mm) insulation thickness, a nominal jacket thickness of 0.022 inch (0.556 mm), a nominal outer diameter of 0.289 inch (7.34 mm), a nominal capacitance of 15.93 pF/FT (52.26 pF/m), and a characteristic impedance at 1 MHz of 99.1 ohms.

It is to be understood that the wire (using a key as follows: J=jacket; S=insulating sheath; $F^C$=clockwise-wrapped fiberglass layer; $F^{CC}$=counterclockwise-wrapped fiberglass layer; $F^B$=braided fiberglass layer; $F^T$=two directional serve fiberglass layer; $J^P$=plenum rated jacket; $S^I$=plenum rated insulating sheath; M=mica layer; C=conductor) can be made in at least the following ways: $CMF^BS$; $CMF^BSJ$; $CMF^TS$; $CMF^TSJ$; $CMF^BMF^BS$; $CMF^BMF^BSJ$; $CMF^BMF^TS$; $CMF^BMF^TSJ$; $CMF^TMF^TS$; $CMF^TMF^TSJ$; $CMF^TMF^BS$; $CMF^TMF^BSJ$; $CMF^BS^P$; $CMF^BS^PJ^P$; $CMF^TS^P$; $CMF^TS^PJ^P$; $CMF^BMF^BS^P$; $CMF^BMF^BS^PJ^P$; $CMF^BMF^TS^P$; $CMF^BMF^TS^PJ^P$; $CMF^TMF^TS^P$; $CMF^TMF^TS^PJ^P$; $CMF^TMF^BS^P$; $CMF^TMF^BS^PJ^P$; $CMF^CMF^{CC}S$; $CMF^{CC}MF^CS$; $CMF^CMF^{CC}SJ$; $CMF^{CC}MF^CSJ$; $CMF^CMF^{CC}S^P$; $CMF^{CC}MF^CS^P$; $CMF^CMF^{CC}S^PJ^P$; $CMF^{CC}MF^CS^PJ^P$; $CMF^BSJ^P$; $CMF^BS^PJ$; $CMF^TSJ^P$; $CMF^TS^PJ$; $CMF^BMF^BSJ^P$; $CMF^BMF^BS^PJ$; $CMF^BMF^TSJ^P$; $CMF^BMF^TS^PJ$; $CMF^TMF^TSJ^P$; $CMF^TMF^TS^PJ$; $CMF^TMF^BSJ^P$; $CMF^TMF^BS^PJ$; $CMF^CMF^{CC}SJ^P$; $CMF^CMF^{CC}S^PJ$; $CMF^{CC}MF^CS^PJ$; $CMF^{CC}MF^CSJ^P$.

The embodiments have been described, hereinabove. It will be apparent to those skilled in the art that the above methods and apparatuses may incorporate changes and modifications without departing from the general scope of the present teachings. It is intended to include all such modifications and alterations insofar as they come within the scope of the appended claims or the equivalents thereof. Although the description above contains much specificity, this should not be construed as limiting the scope of the present teachings, but as merely providing illustrations of some of the embodiments of the present teachings. Various other embodiments and ramifications are possible within its scope.

Furthermore, notwithstanding that the numerical ranges and parameters setting forth the broad scope of the present teachings are approximations, the numerical values set forth in the specific examples are reported as precisely as possible. Any numerical value, however, inherently contain certain errors necessarily resulting from the standard deviation found in their respective testing measurements.

Clause 1—A free air fire alarm cable comprising a metal conductor, wherein the conductor has an AWG of 12 or smaller, wherein the metal conductor has a top and a bottom; a first mica layer in direct contact with the metal conductor, wherein the first mica layer has a first edge and a second edge, wherein the first mica layer is folded around the metal conductor such that the first edge and second edge are substantially parallel to one another and the first edge overlaps the second edge on the bottom of the metal conductor; a first high tensile, high temperature fiberglass layer clockwise spiral-wrapped directly onto the first mica layer, the first fiberglass layer having a top and a bottom; a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer; a second high tensile, high temperature fiberglass layer counterclockwise spiral-wrapped directly onto the second mica layer; and a insulating sheath around the second fiberglass layer, wherein the cable has no conduit.

Clause 2—An electric wire comprising a metal conductor; a heat stable tape, wherein the tape is in direct contact with the conductor, wherein the tape can withstand temperatures of at least about 1850° F. (1010° C.); a high temperature fiberglass layer, wherein the fiberglass layer is in direct contact with the tape; and an insulating sheath around the fiberglass layer, wherein the wire has no conduit protection.

Clause 3—The wire of clause 2, wherein the tape has a first edge and a second edge, wherein the tape is folded around the metal conductor such that the first edge and second edge are substantially parallel to one another and the first edge overlaps the second edge.

Clause 4—The wire of clauses 2 or 3, wherein the fiberglass layer is braided over the tape.

Clause 5—The wire of clauses 2-4, wherein the tape is mica tape.

Clause 6—The wire of clauses 2, 3, or 5, wherein the fiberglass layer is a two directional serve layer.

Clause 7—The wire of clauses 2-6, wherein the tape is folded around the conductor.

Clause 8—The wire of clauses 2, 3, 5, or 7, wherein the tape is mica and is a first mica layer, the high temperature fiberglass layer is a first fiberglass layer, the metal conductor has a top and a bottom, the wire further comprising the first mica layer having a first edge and a second edge, wherein the first mica layer is folded around the metal conductor such that the first edge and second edge are substantially parallel to one another and the first edge overlaps the second edge on the bottom of the metal conductor; the first high temperature fiberglass layer clockwise spiral-wrapped directly onto the first mica layer, the first fiberglass layer having a top and a bottom; a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer; and a second high temperature fiberglass layer counterclockwise spiral-wrapped directly onto the second mica layer, wherein the insulating sheath is around the second fiberglass layer.

Clause 9—The wire of clauses 2-8, wherein the conductor has an AWG of 12 or smaller.

Clause 10—A plenum-rated electric wire comprising a metal conductor; a heat stable tape layer, wherein the tape layer is in direct contact with the conductor, wherein the tape layer can withstand temperatures of at least about 1850° F. (1010° C.); a high temperature fiberglass layer, wherein the fiberglass layer is in direct contact with the tape, wherein there is no silicone between the tape and the fiberglass layer; and a plenum-rated insulating sheath around the fiberglass layer.

Clause 11—The wire of clause 10, wherein the tape has a first edge and a second edge, wherein the tape is folded around the metal conductor such that the first edge and second edge are substantially parallel to one another and the first edge overlaps the second edge.

Clause 12—The wire of clauses 10 or 11, wherein the fiberglass layer is braided over the tape.

Clause 13—The wire of clauses 10-12, wherein the tape is mica tape.

Clause 14—The wire of clauses 10, 11, or 13, wherein the fiberglass layer is a two directional serve layer.

Clause 15—The wire of clauses 10-14, wherein the tape is folded around the conductor.

Clause 16—The wire of clauses 10, 11, 13, or 15, wherein the tape is mica and is a first mica layer, the high temperature fiberglass layer is a first fiberglass layer, the metal conductor has a top and a bottom, the wire further comprising the first mica layer having a first edge and a second edge, wherein the first mica layer is folded around the metal conductor such that the first edge and second edge are substantially parallel to one another and the first edge overlaps the second edge on the bottom of the metal conductor; the first high temperature fiberglass layer clockwise spiral-wrapped directly onto the first mica layer, the first fiberglass layer having a top and a bottom; a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer; and a second high temperature fiberglass layer counterclockwise spiral-wrapped directly onto the second mica layer, wherein the insulating sheath is around the second fiberglass layer.

Clause 17—The wire of clauses 10-16, wherein the wire further comprises a plenum-rated jacket around the insulating sheath, wherein the wire has no conduit protection.

Clause 18—The wire of clauses 10-17, wherein the conductor has an AWG of 12 or smaller.

What is claimed is:

1. A free air fire alarm cable comprising:

a metal conductor, wherein the conductor has an AWG of 12 or smaller, wherein the metal conductor has a top and a bottom;

a first mica layer in direct contact with the metal conductor, wherein the first mica layer has a first edge and a second edge, wherein the first mica layer is folded around the metal conductor such that the first edge and second edge are substantially parallel to one another and the first edge overlaps the second edge on the bottom of the metal conductor;

a first high tensile, high temperature fiberglass layer clockwise spiral-wrapped directly onto the first mica layer, the first fiberglass layer having a top and a bottom;

a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer;

a second high tensile, high temperature fiberglass layer counterclockwise spiral-wrapped directly onto the second mica layer; and an insulating sheath around the second fiberglass layer, wherein the cable has no conduit.

2. An electric wire comprising:

a metal conductor, a heat stable tape layer, wherein the tape is in direct contact with the conductor, wherein the tape can withstand temperatures of at least about 1850° F.;

a high temperature fiberglass layer, wherein the fiberglass layer is in direct contact with the tape layer, wherein the tape is folded around the conductor, wherein the fiberglass layer is wrapped around the heat stable tape layer, wherein the heat stable tape layer and fiberglass layer are separate layers, wherein the tape is mica and is a first mica layer, the high temperature fiberglass layer is a first fiberglass layer, the metal conductor has a too and a bottom;

the first mica layer having a first edge and a second edge, wherein the first mica layer is folded around the metal conductor such that the first edge and second edge are substantially parallel to one another and the first edge overlaps the second edge on the bottom of the metal conductor;

the first high temperature fiberglass layer clockwise spiral-wrapped directly onto the first mica layer, the first fiberglass layer having a top and a bottom;

a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer; and a second high temperature fiberglass layer counterclockwise spiral-wrapped directly onto the second mica layer, wherein an insulating sheath is around the second fiberglass layer, wherein the wire has no conduit protection.

3. The wire of claim 2, wherein the tape has a first edge and a second edge, wherein the tape is folded around the metal conductor such that the first edge and second edge are substantially parallel to one another and the first edge overlaps the second edge.

4. The wire of claim 3, wherein the fiberglass layer is braided over the tape.

5. The wire of claim 4, wherein the tape is mica tape.

6. The wire of claim 3, wherein the fiberglass layer is a two directional serve layer.

7. The wire of claim 2, wherein the conductor has an AWG of 12 or smaller.

8. A plenum-rated electric wire comprising:

a metal conductor;

a heat stable tape layer, wherein the tape layer is in direct contact with the conductor, wherein the tape layer can withstand temperatures of at least about 1850° F.;

a high temperature fiberglass layer, wherein the fiberglass layer is in direct contact with the tape, wherein there is no silicone between the tape and the fiberglass layer;

a plenum-rated insulating sheath, wherein the tape is folded around the conductor, wherein the fiberglass layer is wrapped around the heat stable tape layer, wherein the heat stable tape and fiberglass layer are separate layers, wherein the tape is mica and is a first mica layer, the high temperature fiberglass layer is a first fiberglass layer, the metal conductor has a top and a bottom;

the first mica layer having a first edge and a second edge, wherein the first mica layer is folded around the metal conductor such that the first edge and second edge are substantially parallel to one another and the first edge overlaps the second edge on the bottom of the metal conduct;

the first high temperature fiberglass layer clockwise spiral-wrapped directly onto the first mica layer, the first fiberglass layer having a top and a bottom;

a second mica layer in direct contact with the first fiberglass layer, wherein the second mica layer has a first edge and a second edge, wherein the second mica layer is folded around the first fiberglass layer such that the first edge of the second mica layer and second edge of the second mica layer are substantially parallel to one another and the first edge of the second mica layer overlaps the second edge of the second mica layer on the top of the first fiberglass layer; and a second high temperature fiberglass later counterclockwise spiral-wrapped directly onto the second mica layer, wherein the insulating sheath is around the second fiberglass layer.

9. The wire of claim 8, wherein the tape has a first edge and a second edge, wherein the tape is folded around the metal conductor such that the first edge and second edge are substantially parallel to one another and the first edge overlaps the second edge.

10. The wire of claim 9, wherein the fiberglass layer is braided over the tape.

11. The wire of claim 10, wherein the tape is mica tape.

12. The wire of claim 9, wherein the fiberglass layer is a two directional serve layer.

13. The wire of claim 8, wherein the wire further comprises a plenum-rated jacket around the insulating sheath, wherein the wire has no conduit protection.

14. The wire of claim 13, wherein the conductor has an AWG of 12 or smaller.

15. The wire of claim 8, wherein the wire meets NFPA 262 standards and passes requirements of UL 2196.

16. The wire of claim 8, wherein the wire meets requirements of UL 444.

* * * * *